US011133140B2

(12) United States Patent
Inoue

(10) Patent No.: US 11,133,140 B2
(45) Date of Patent: Sep. 28, 2021

(54) CONTACT DEVICE AND ELECTROMAGNETIC RELAY

(71) Applicant: PANASONIC INTELLECTUAL PROPERTY MANAGEMENT CO., LTD., Osaka (JP)

(72) Inventor: Rei Inoue, Hokkaido (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 179 days.

(21) Appl. No.: 16/594,541

(22) Filed: Oct. 7, 2019

(65) Prior Publication Data

US 2020/0035434 A1 Jan. 30, 2020

Related U.S. Application Data

(63) Continuation of application No. PCT/JP2018/014370, filed on Apr. 4, 2018.

(30) Foreign Application Priority Data

Apr. 14, 2017 (JP) ..... JP2017-080945

(51) Int. Cl.
*H01H 50/54* (2006.01)
*H01H 50/56* (2006.01)
(Continued)

(52) U.S. Cl.
CPC ..... *H01H 50/56* (2013.01); *H01H 1/64* (2013.01); *H01H 50/041* (2013.01);
(Continued)

(58) Field of Classification Search
CPC ..... H01H 50/56; H01H 1/64; H01H 50/041; H01H 50/14; H01H 50/18; H01H 50/36; H01H 2001/5888; H01H 1/26; H01H 1/28
(Continued)

(56) References Cited

U.S. PATENT DOCUMENTS 3,750,060 A * 7/1973 Pfenning ..... H01H 51/06 335/135
3,885,115 A * 5/1975 Schrotter ..... H01H 1/26 200/245
(Continued)

FOREIGN PATENT DOCUMENTS

DE 10 2010 017 875 A1 10/2011
EP 3113204 1/2017
(Continued)

OTHER PUBLICATIONS

Official Communication issued in International Bureau of WIPO Patent Application No. PCT/JP2018/014370, dated Jun. 5, 2018.
(Continued)

*Primary Examiner* — Shawki S Ismail
*Assistant Examiner* — Lisa N Homza
(74) *Attorney, Agent, or Firm* — Greenblum & Bernstein, P.L.C.

(57) ABSTRACT

A contact device according to an embodiment includes: a fixed contact assembly including a first fixed contact and a second fixed contact; and a moving contact assembly including a first moving contact and a second moving contact. The moving contact assembly includes: a first moving member; and a second moving member. The second moving member is arranged, in a first direction, between the first moving member and the fixed contact assembly and fixed to the first moving member at one end in a second direction intersecting
(Continued)

with the first direction. The first moving contact and the second moving contact move as the first moving member moves. A first distance from the one end in the second direction to the first moving contact is longer than a second distance from the one end in the second direction to the second moving contact.

12 Claims, 6 Drawing Sheets

(51) Int. Cl.

| | |
|---|---|
| ***H01H 1/64*** | (2006.01) |
| ***H01H 50/04*** | (2006.01) |
| ***H01H 50/14*** | (2006.01) |
| ***H01H 50/18*** | (2006.01) |
| ***H01H 50/36*** | (2006.01) |
| *H01H 1/58* | (2006.01) |

(52) U.S. Cl.
CPC ..... *H01H 50/14* (2013.01); *H01H 50/18* (2013.01); *H01H 50/36* (2013.01); *H01H 2001/5888* (2013.01)

(58) Field of Classification Search
USPC ..... 335/2
See application file for complete search history.

(56) References Cited

U.S. PATENT DOCUMENTS 4,087,667 A * 5/1978 Heider ..... H01H 1/26 200/245
4,322,700 A * 3/1982 Everhart ..... H01H 50/56 335/128
4,684,909 A * 8/1987 Dittmann ..... H01H 50/60 335/128
6,046,661 A * 4/2000 Reger ..... H01H 50/56 335/185
6,448,877 B1 * 9/2002 Harayama ..... H01H 50/042 335/78
8,653,915 B2 * 2/2014 Schmidt ..... H01H 51/06 335/185
8,686,817 B2 * 4/2014 Kubono ..... H01H 50/643 335/78

FOREIGN PATENT DOCUMENTS

| | | |
|---|---|---|
| JP | 51-045264 | 4/1976 |
| JP | 53-61043 | 5/1978 |
| JP | 54-129463 | 10/1979 |
| JP | 59-126443 | 8/1984 |
| JP | 2005-166431 | 6/2005 |
| JP | 2005-166433 | 6/2005 |
| JP | 2011-081961 | 4/2011 |
| JP | 2015-159025 | 9/2015 |

OTHER PUBLICATIONS

Canadian Office Action issued in Canada Patent Application No. 2970289, dated Oct. 7, 2019.
International Preliminary Report on Patentability issued in Patent Application No. PCT/JP2018/014370, dated Oct. 15, 2019.
Supplementary European Search Report issued in Application No. EP 18 78 3734, dated Feb. 28, 2020.

* cited by examiner

CONTACT DEVICE AND ELECTROMAGNETIC RELAY

CROSS-REFERENCE TO RELATED APPLICATIONS

This application is a U.S. continuation of International Patent Application No. PCT/JP2018/014370, filed on Apr. 4, 2018, which in turn claims the benefit of priority to Japanese Patent Application No. 2017-080945, filed on Apr. 14, 2017. The entire disclosures of these applications are hereby incorporated by reference.

TECHNICAL FIELD

The present disclosure generally relates to a contact device and an electromagnetic relay, and more particularly relates to a contact device including a moving contact and a fixed contact and an electromagnetic relay including such a contact device.

BACKGROUND ART

JP 2011-81961 A discloses an electromagnetic relay configured to open and close contacts as an electromagnet is actuated. The electromagnetic relay of JP 2011-81961 A includes a base block, an electromagnet embedded in the base block, contacts to open and close as the electromagnet is actuated, and a cover enclosing the electromagnet and the contacts. The contacts include moving contacts, upper fixed contacts arranged over the moving contacts, and lower fixed contacts arranged under the moving contacts.

In the electromagnetic relay of JP 2011-81961 A, the moving contacts come into contact with the upper fixed contacts when the electromagnet is not actuated and come into contact with the lower fixed contacts when the electromagnet is actuated.

The electromagnetic relay of JP 2011-81961 A provides two moving contacts, two upper fixed contacts, and two lower fixed contacts in the rightward/leftward direction to enable the electromagnetic relay to be supplied with a large amount of current, and therefore, has an increased outer dimension in the rightward/leftward direction.

SUMMARY

The present disclosure provides a contact device and an electromagnetic relay, which may be energized with a large amount of current supplied and yet have a reduced overall size.

A contact device according to an aspect includes a fixed contact assembly and a moving contact assembly. The fixed contact assembly includes a first fixed contact and a second fixed contact. The moving contact assembly includes a first moving contact and a second moving contact. The first moving contact faces, in a first direction, the first fixed contact, and moves back and forth between a first closed position where the first moving contact comes into contact with the first fixed contact and a first open position where the first moving contact goes out of contact with the first fixed contact. The second moving contact faces, in the first direction, the second fixed contact, and moves back and forth between a second closed position where the second moving contact comes into contact with the second fixed contact and a second open position where the second moving contact goes out of contact with the second fixed contact. The moving contact assembly further includes a first moving member and a second moving member. The first moving member is implemented as a leaf spring and is provided with the first moving contact. The second moving member is provided with the second moving contact. The second moving member is arranged, in the first direction, between the first moving member and the fixed contact assembly and fixed to the first moving member at one end in a second direction intersecting with the first direction. The first moving contact and the second moving contact are configured to move as the first moving member moves. A first distance from the one end in the second direction to the first moving contact is longer than a second distance from the one end in the second direction to the second moving contact.

An electromagnetic relay according to another aspect includes: the contact device described above; and an electromagnetic device. The electromagnetic device includes a coil and configured to move the moving contact assembly depending on whether the coil is energized or not.

DESCRIPTION OF EMBODIMENTS

Figure 1:
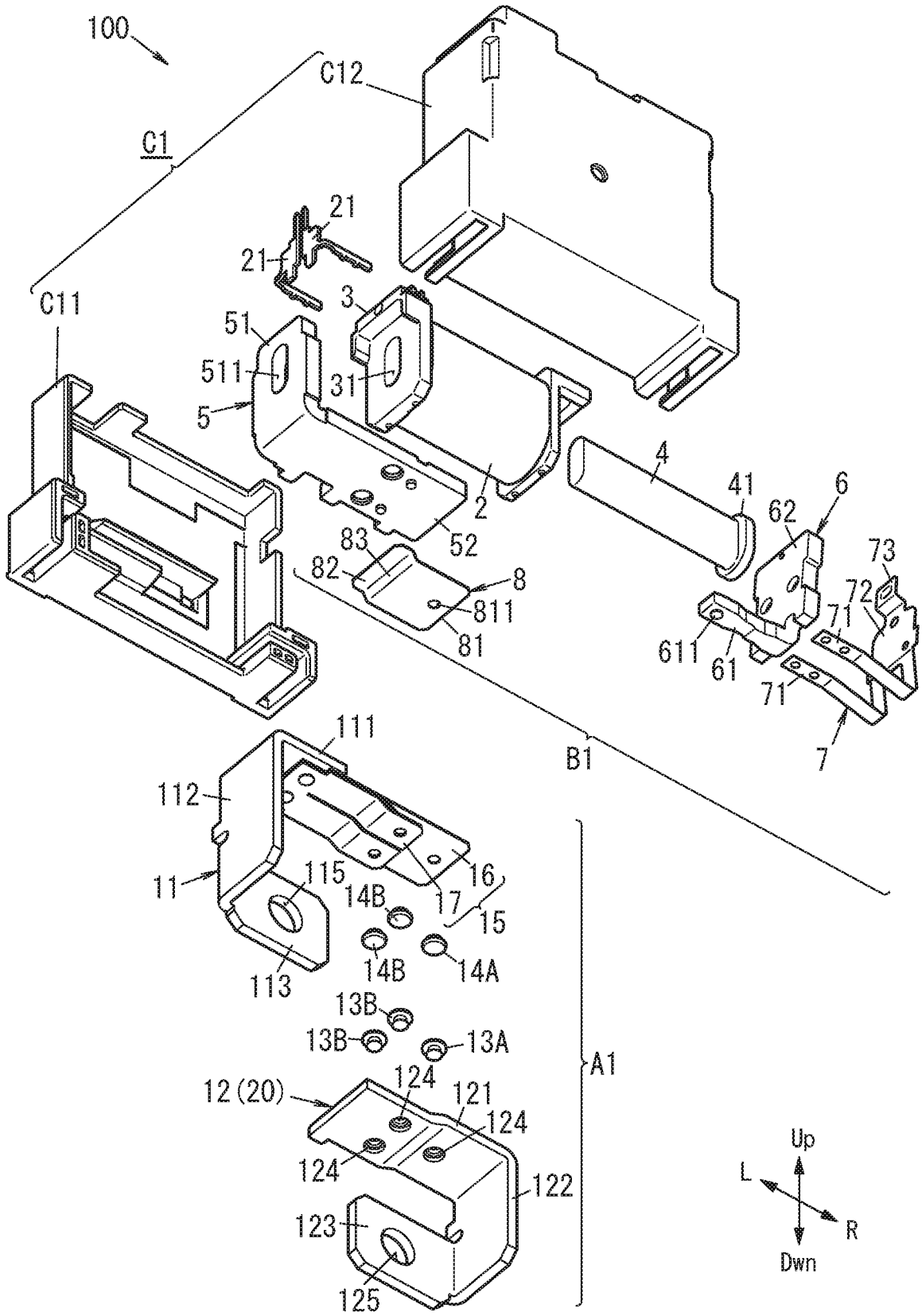
FIG. 1 is an exploded perspective view of a contact device and electromagnetic relay according to an exemplary embodiment of the present disclosure.

An exemplary embodiment of the present disclosure will now be described. Note that the exemplary embodiment to be described below is only one of various embodiments of the present disclosure and should not be construed as limiting. Rather, the embodiment may be readily modified in various manners, depending on a design choice or any other factor, without departing from a true spirit and scope of the present disclosure.

(1) Overview of Contact Device and Electromagnetic Relay

An overview of a contact device and electromagnetic relay according to an exemplary embodiment will be described.

The contact device and electromagnetic relay according to this embodiment may be used, for example, as a device for switching the state of supply of DC power from the battery of an automobile to a load (such as a motor). The electromagnetic relay according to this embodiment inserts the contact device into a path for supplying DC power from a power supply such as the battery to the load and is able to switch the state of supply of the DC power from the battery to the load by opening and closing the contact device. In that case, a load current from the motor flows through the contact device and may have an amount of several hundred amperes or more. That is to say, when the load is a motor for an automobile as in this embodiment, the contact device needs to deal with a large amount of current of several hundred amperes or more.

An electromagnetic relay including a moving contact at the tip of a single moving contact spring, which is formed in the shape of a plate elongated in one direction, has been provided. In such an electromagnetic relay, Joule heat is generated by a large amount of current flowing between the moving contact and a fixed contact and deforms the moving contact spring, thus causing a decline in contact pressure between the moving contact and the fixed contact, which eventually leads to a decline in the current carrying capacity of the electromagnetic relay.

Meanwhile, an electromagnetic relay that uses a braided wire in combination with the moving contact spring has also been provided. Such an electromagnetic relay is able to dissipate the Joule heat, generated between the moving contact and the fixed contact, through the braided wire, thus reducing the deformation of the moving contact spring due to the Joule heat. This keeps the contact pressure between the moving contact and the fixed contact high enough to avoid a decline in the current carrying capacity of the electromagnetic relay. In that case, however, the braided wire is too soft to be positioned easily, thus making it difficult to automate the process step of installing the braided wire.

In addition, the electromagnetic relay is usually installed near a battery housing space, for example, and therefore, needs to have a reduced overall size.

Thus, to meet these demands for enabling energizing the electromagnetic relay with a large amount of current supplied, automatic assembling, and reducing its dimension in the third direction (i.e., the thickness direction) all at a time, a contact device and electromagnetic relay according to this embodiment have the following configurations:

A contact device A1 according to this embodiment includes a fixed contact assembly 20 and a moving contact assembly 15 as shown in FIG. 1. The fixed contact assembly 20 includes a first fixed contact 13A and a second fixed contact 13B. The moving contact assembly 15 includes a first moving contact 14A and a second moving contact 14B. The first moving contact 14A faces, in a first direction (upward/downward direction), the first fixed contact 13A, and moves back and forth between a first closed position where the first moving contact 14A comes into contact with the first fixed contact 13A and a first open position where the first moving contact 14A goes out of contact with the first fixed contact 13A. The second moving contact 14B faces, in the first direction, the second fixed contact 13B, and moves back and forth between a second closed position where the second moving contact 14B comes into contact with the second fixed contact 13B and a second open position where the second moving contact 14B goes out of contact with the second fixed contact 13B. The moving contact assembly 15 further includes a first moving member 16 and a second moving member 17. The first moving member 16 is implemented as a leaf spring and is provided with the first moving contact 14A. The second moving member 17 is provided with the second moving contact 14B. The second moving member 17 is arranged, in the first direction, between the first moving member 16 and the fixed contact assembly 20. The second moving member 17 is fixed to the first moving member 16 at one end (left end) in a second direction (rightward/leftward direction) intersecting with the first direction. The first moving contact 14A and the second moving contact 14B are configured to move as the first moving member 16 moves. A first distance L1 from the one end in the second direction of the second moving member 17 to the first moving contact 14A (see FIG. 5A) is longer than a second distance L2 from the one end in the second direction of the second moving member 17 to the second moving contact 14B (see FIG. 5A).

An electromagnetic relay 100 according to this embodiment includes the contact device A1 and an electromagnetic device B1 as shown in FIG. 1. The electromagnetic device B1 includes a coil 2 and configured to move the moving contact assembly 15 depending on whether the coil 2 is energized or not.

The contact device A1 and electromagnetic relay 100 according to this embodiment are configured such that at the closed position, the first fixed contact 13A and the first moving contact 14A come into contact with each other and the second fixed contact 13B and the second moving contact 14B come into contact with each other. In addition, the first moving contact 14A and the second moving contact 14B are arranged side by side in a second direction intersecting with the first direction (i.e., the direction in which the first fixed contact 13A and the first moving contact 14A face each other). This allows the overall size of the contact device A1 and electromagnetic relay 100 according to this embodiment to be reduced in a third direction, intersecting with both of the first and second directions, while energizing the contact device A1 with a large amount of current supplied. In addition, the contact device A1 and electromagnetic relay 100 according to this embodiment do not use any braided wire unlike the known electromagnetic relay, thus facilitating positioning of respective members and enabling automatic assembling as well.

(2) Details of Contact Device and Electromagnetic Relay

Next, the contact device A1 and electromagnetic relay 100 according to this embodiment will be described in further detail with reference to FIGS. 1-4.

In the following description, the direction in which the first fixed contact 13A and the first moving contact 14A are arranged will be hereinafter referred to as an "upward/downward direction," the direction in which the first moving contact 14A is located when viewed from the first fixed contact 13A will be hereinafter referred to as an "upward direction," and the opposite direction will be hereinafter referred to as a "downward direction." Also, in the following description, the direction in which the first moving contact 14A and the second moving contacts 14B are arranged side by side in FIG. 1 will be hereinafter referred to as a "rightward/leftward direction," the direction in which the second moving contact 14B is located when viewed from the first moving contact 14A will be hereinafter referred to as a "leftward direction," and the opposite direction will be hereinafter referred to as a "rightward direction." That is to say, according to this embodiment, the direction in which the first fixed contact 13A and the first moving contact 14A are arranged, i.e., the direction in which the first fixed contact 13A and the first moving contact 14A face each other, is the first direction (upward/downward direction). Also, the direction in which the first moving contact 14A and the second moving contact 14B are arranged side by side, i.e., the direction intersecting with the first direction, is the second direction (rightward/leftward direction). Furthermore, the direction intersecting with both of the first and second directions is the third direction (forward/backward direction).

Note that even though arrows indicating these directions (namely, upward, downward, leftward, and rightward directions) are shown in FIGS. 1-6, these arrows are just shown there as an assistant to description and are insubstantial ones.

It should also be noted that these directions do not define how the electromagnetic relay 100 should be used.

The electromagnetic relay 100 according to this embodiment is implemented as a so-called "hinged relay." The electromagnetic relay 100 according to this embodiment includes the contact device A1, an electromagnetic device B1, and a case C1 as shown in FIG. 1.

The contact device A1 includes a first terminal plate 11, a second terminal plate 12, a first fixed contact 13A, a pair of second fixed contacts 13B, a first moving contact 14A, a pair of second moving contacts 14B, and a moving contact assembly 15.

Figure 3:
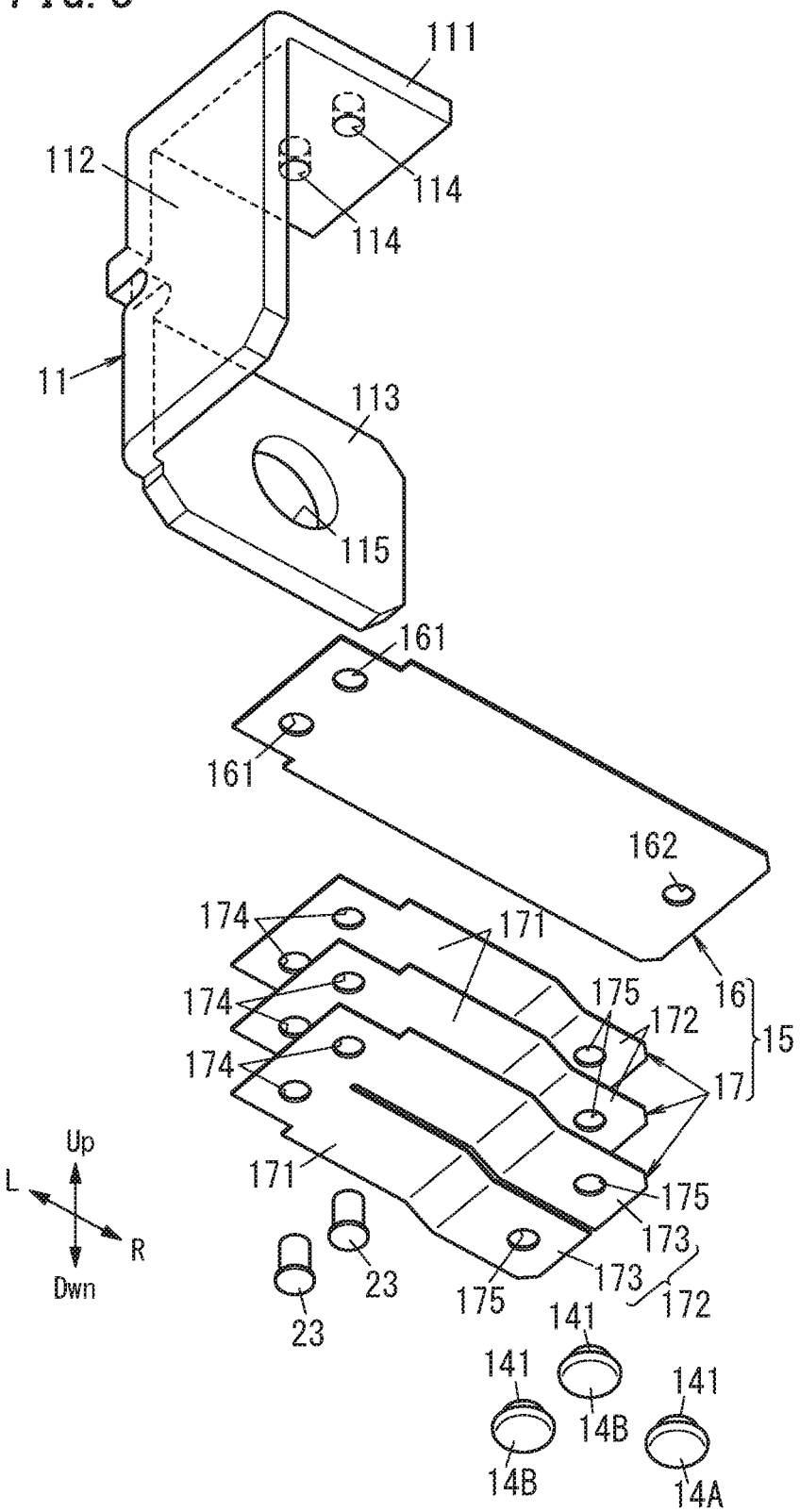
FIG. 3 is an exploded perspective view of a moving contact assembly of the contact device.

The first terminal plate 11 may be made of an electrically conductive material (such as copper) and formed to have an L-shape in a front view. The first terminal plate 11 includes a first lateral plate 111 and a first vertical plate 112 as shown in FIG. 3. The first lateral plate 111 and the first vertical plate 112 are each formed in a rectangular plate shape. A pair of fixing holes 114 are cut through the thickness (upward/downward direction) of the first lateral plate 111 so as to be arranged along a line passing through the middle of the length (rightward/leftward direction) of the first lateral plate 111. The pair of fixing holes 114 is used to secure the moving contact assembly 15 to the first terminal plate 11 (more specifically, the first lateral plate 111 thereof in this example).

The first vertical plate 112 protrudes downward from one end (left end) portion along the length (rightward/leftward direction) of the first lateral plate 111. The first vertical plate 112 includes a first terminal portion 113. The first terminal portion 113 is formed in a rectangular plate shape and protrudes rightward from one end (lower end) portion along the length (upward/downward direction) of the first vertical plate 112. The first terminal portion 113 has a circular, first terminal hole 115 to which a screw or any other fastening member is inserted.

Figure 4:
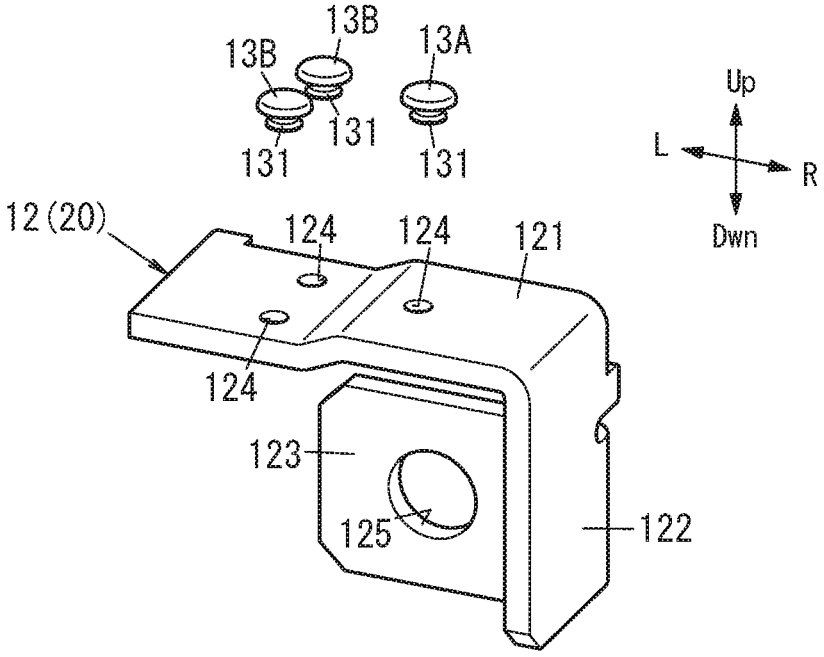
FIG. 4 is an exploded perspective view of a fixed contact assembly of the contact device.

The second terminal plate 12 may be made of an electrically conductive material (such as copper) and formed to have an L-shape in a front view. The second terminal plate 12 includes a second lateral plate 121 and a second vertical plate 122 as shown in FIG. 4. The second lateral plate 121 and the second vertical plate 122 are each formed in a rectangular plate shape. A plurality of (e.g., three in the illustrated example) mounting holes 124 are cut through the thickness (upward/downward direction) of the second lateral plate 121 so as to be arranged around a line passing through the middle of the length (rightward/leftward direction) of the second lateral plate 121. Two mounting holes 124, out of the three mounting holes 124, are provided closer to the left edge of the second terminal plate 12 and the other mounting hole 124 is provided closer to the right edge thereof.

A shaft portion 131 of the first fixed contact 13A is inserted into the mounting hole 124 located closer to the right edge. Then, caulking the shaft portion 131 and the second terminal plate 12 (more specifically, the second lateral plate 121 thereof in this example) together allows the first fixed contact 13A to be mounted to the second terminal plate 12. The respective shaft portions 131 of the pair of second fixed contacts 13B are inserted into the two mounting holes 124 located closer to the left edge. Then, caulking the respective shaft portions 131 and the second terminal plate 12 (more specifically, the second lateral plate 121 thereof in this example) together allows the pair of second fixed contacts 13B to be mounted to the second terminal plate 12. Optionally, the first fixed contact 13A and the pair of second fixed contacts 13B may form respective integral parts of the second terminal plate 12.

The second vertical plate 122 protrudes downward from one end (right end) portion along the length of the second lateral plate 121. The second vertical plate 122 includes a second terminal portion (terminal portion) 123. The second terminal portion 123 is formed in a rectangular plate shape and protrudes leftward from one end (lower end) portion along the length (upward/downward direction) of the second vertical plate 122. The second terminal portion 123 has a circular, second terminal hole 125 to which a screw or any other fastening member is inserted. In this embodiment, the second terminal plate 12 to which the first fixed contact 13A and the pair of second fixed contacts 13B are mounted constitutes the fixed contact assembly 20.

The first terminal portion 113 may be electrically connected, with screws, for example, to one of the battery or the load (e.g., the motor in this example). The second terminal portion 123 may be electrically connected, with screws, for example, to the other of the battery or the load. In this embodiment, one of the battery or the load electrically connected to the second terminal portion 123 corresponds to the external circuit.

The moving contact assembly 15 includes a first moving member 16 consisting of a single part, and a second moving member 17 consisting of multiple parts (e.g., three parts in this example) as shown in FIG. 3. The first moving member 16 may be made of an electrically conductive material (such as copper) and formed in the shape of a plate elongated in the rightward/leftward direction. Each of the multiple parts of the second moving member 17 may also be made of an electrically conductive material (such as copper) and formed in the shape of a plate elongated in the rightward/leftward direction. Each of the first moving member 16 and the multiple parts of the second moving member 17 may be implemented as a leaf spring, for example. The first moving member 16 has a greater dimension as measured in the rightward/leftward direction than the second moving member 17.

One end (left end) portion along the length (rightward/leftward direction) of the first moving member 16 has a pair of fixing holes 161 cut through the thickness (upward/downward direction) thereof. The pair of fixing holes 161 is used to secure the first moving member 16 to the first terminal plate 11 (more specifically, the first lateral plate 111 thereof in this example). The other end (right end) portion along the length of the first moving member 16 has a mounting hole 162 cut through the thickness thereof. The shaft portion 141 of the first moving contact 14A is inserted into the mounting hole 162. Then, caulking the shaft portion 141 and the first moving member 16 together allows the first moving contact 14A to be mounted to the first moving member 16. Alternatively, the first moving contact 14A may form an integral part of the first moving member 16.

Each of the multiple parts of the second moving member 17 includes a mounting portion 171 and a stepped portion 172 as shown in FIG. 3. The mounting portion 171 is formed in the shape of a plate elongated in the rightward/leftward direction. A pair of fixing holes 174 are cut through the thickness (upward/downward direction) of the mounting portion 171 at one end (left end) portion along the length (rightward/leftward direction) of the mounting portion 171. The pair of fixing holes 174 is used to secure the second moving member 17, along with the first moving member 16, to the first terminal plate 11 (more specifically, the first lateral plate 111 thereof in this example). The stepped portion 172 protrudes from the other end (right end) portion along the length of the mounting portion 171 away from the first moving member 16 along the thickness (upward/downward direction) thereof (i.e., protrudes downward). In other words, the second moving member 17 includes, at the other end (right end) in the second direction (rightward/leftward direction), the stepped portion 172 protruding in the first direction (upward/downward direction) away from the first moving member 16.

The stepped portion 172 is divided, in the forward/backward direction (third direction) intersecting with both of the upward/downward direction (first direction) and the rightward/leftward direction (second direction), into a plurality of (e.g., two in the illustrated example) second moving contact divided pieces 173. Each of the plurality of second moving contact divided pieces 173 has a mounting hole 175 cut through the thickness (upward/downward direction) thereof. The shaft portion 141 of one of the pair of second moving contacts 14B is inserted into each mounting hole 175. Then, caulking the shaft portion 141 and the second moving contact divided piece 173 together allows the second moving contact 14B to be mounted to the second moving contact divided piece 173. Providing the second moving contact 14B for each of the plurality of second moving contact divided pieces 173 divided in the third direction reduces dispersion in contact pressure between the plurality of second moving contacts 14B. Alternatively, the pair of second moving contacts 14B may form integral parts of the second moving member 17.

In this embodiment, the moving contact assembly 15 is made up of multiple (e.g., three in the illustrated example) parts of the second moving member 17 that are stacked one on top of another in the upward/downward direction and the single part of the first moving member 16. In other words, the number of parts of the first moving member 16 provided is different from the number of parts of the second moving member 17 provided. Then, the pair of fixing holes 161 of the first moving member 16 and the respective pairs of fixing holes 174 of the multiple parts of the second moving member 17 are aligned with the pair of fixing holes 114 of the first terminal plate 11 and pins 23 (see FIG. 2) are inserted into these fixing holes 161, 174, 114 to caulk these members 11, 16, 17 together. This allows the single part of the first moving member 16 and the multiple parts of the second moving member 17 to be secured to the first terminal plate 11 (see FIG. 2). Making the number of parts of the first moving member 16 provided different from that of the second moving member 17 provided in this manner allows the current capacity of the current flowing through the moving contact assembly 15 to be set arbitrarily.

By being driven by the electromagnetic device B1, the moving contact assembly 15 (including the first moving member 16 and the second moving member 17) moves the first moving contact 14A and the pair of second moving contacts 14B, around the points (pins 23) at which the moving contact assembly 15 is secured to the first terminal plate 11 as fulcrums, back and forth between an open position and a closed position. Specifically, the first moving contact 14A moves back and forth between a first closed position (see FIG. 5B) where the first moving contact 14A comes into contact with the first fixed contact 13A and a first open position (see FIG. 5A) where the first moving contact 14A goes out of contact with the first fixed contact 13A. Meanwhile, each of the second moving contacts 14B moves back and forth between a second closed position (see FIG. 5B) where the second moving contact 14B comes into contact with its associated second fixed contact 13B and a second open position (see FIG. 5A) where the second moving contact 14B goes out of contact with the second fixed contact 13B.

When the first moving contact 14A is located at the first closed position and the pair of second moving contacts 14B are located at the second closed position (i.e., when the contact device A1 turns ON), the first terminal plate 11 and the second terminal plate 12 are short-circuited with each other via the moving contact assembly 15. Therefore, when the contact device A1 is ON, the first terminal plate 11 and the second terminal plate 12 are electrically conductive with each other, and DC power is supplied from the battery to the load. On the other hand, when the first moving contact 14A is located at the first open position and the pair of second moving contacts 14B are located at the second open position (i.e., when the contact device A1 turns OFF), the first terminal plate 11 and the second terminal plate 12 are electrically disconnected from each other, and no DC power is supplied from the battery to the load.

Figure 2:
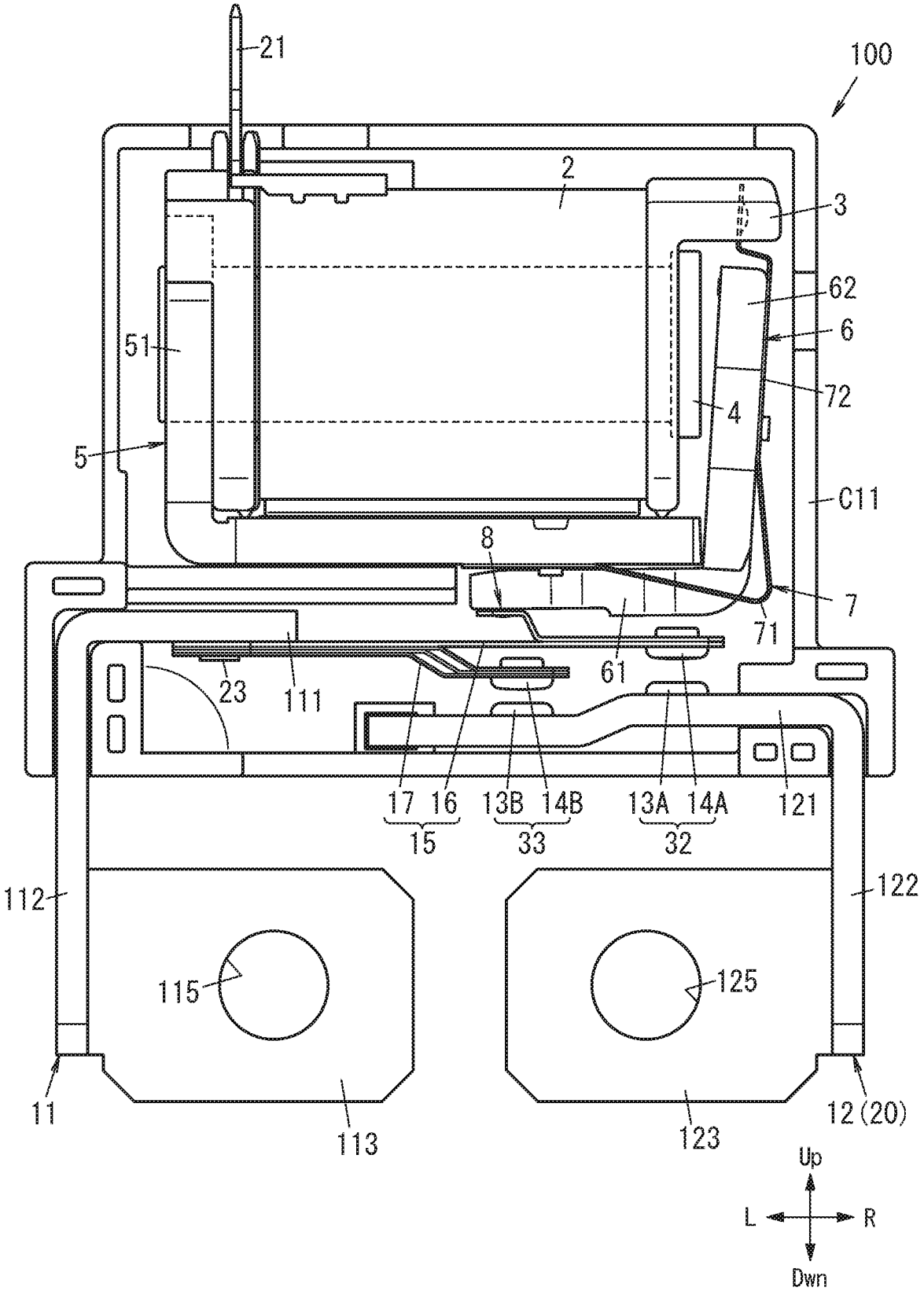
FIG. 2 is a front view illustrating the electromagnetic relay with its cover removed.

The electromagnetic device B1 includes the coil 2, a bobbin 3, a stator 4, a yoke 5, an armature 6, a return spring 7, and a transmission spring 8 as shown in FIGS. 1 and 2. The stator 4, the yoke 5, and the armature 6 are each made of a magnetic material.

The coil 2 is formed by winding an electric wire (such as a copper wire) around an outer peripheral surface of the bobbin 3. The coil 2 includes a pair of coil terminals 21, to which a first end and a second end of the electric wire are respectively electrically connected. Supplying the coil 2 with a current via the pair of coil terminals 21 energizes the coil 2, thus generating a magnetic flux. The bobbin 3 is made of a material with electrical insulation properties such as a synthetic resin material and formed in a square cylindrical shape elongated in the rightward/leftward direction. The bobbin 3 is arranged such that its axis is aligned with the rightward/leftward direction.

The stator 4 is an iron core formed in the shape of an elliptic column elongated in the rightward/leftward direction. The stator 4 is inserted into a hollow portion 31 of the bobbin 3 with both longitudinal ends (i.e., both ends in the rightward/leftward direction) thereof exposed out of the bobbin 3. A first longitudinal end portion (i.e., a right end portion) of the stator 4 has a larger diameter than a middle portion thereof, and faces the armature 6. In the following description, the first end portion of the stator 4 will be hereinafter referred to as an "attracting portion 41." On the other hand, a second longitudinal end portion (left end portion) of the stator 4 is inserted into an insertion hole 511 (to be described later) cut through a first plate 51 (to be described later) of the yoke 5, thereby securing the stator 4 to the yoke 5.

The yoke 5 forms, along with the stator 4 and the armature 6, a magnetic path for the magnetic flux, generated when the coil 2 is energized, to pass through. The yoke 5 is formed to have an L-cross section in a front view by folding a middle portion of a rectangular plate elongated in the rightward/leftward direction. The yoke 5 includes a first plate 51 and a second plate 52 as shown in FIG. 1. Each of the first plate 51 and second plate 52 is formed in a rectangular plate shape. The first plate 51 is provided for one end (i.e., the left end) along the axis (rightward/leftward direction) of the coil 2. The first plate 51 has the insertion hole 511 running through the thickness thereof (in the rightward/leftward direction). The second end portion of the stator 4 is inserted into the insertion hole 511. The second plate 52 is arranged under the coil 2.

The armature 6 is formed to have an L-cross section in a front view by folding a middle portion of a rectangular plate elongated in the rightward/leftward direction. The armature 6 includes a first plate 61 and a second plate 62 as shown in FIG. 1. Each of the first plate 61 and the second plate 62 is formed in the shape of a rectangular plate. The dimension along the width of the first plate 61 is smaller than the dimension along the width of the second plate 62. As used herein, the "width direction" refers to a direction generally perpendicular to both of the upward/downward direction and the rightward/leftward direction (i.e., refers to the forward/backward direction).

The first plate 61 of the armature 6 includes a projection 611 as shown in FIG. 1. The projection 611 projects downward from one surface, facing the first moving member 16 (i.e., the lower surface), of the first plate 61. Also, the projection 611 forms an integral part of the first plate 61.

The armature 6 is configured to be rotatable, around a middle portion as a fulcrum, between a first position where the second plate 62 comes into contact with the attracting portion 41 of the stator 4 and a second position where the second plate 62 goes out of contact with the attracting portion 41 of the stator 4. When the armature 6 is located at the first position, the first plate 61 of the armature 6 (more specifically, the projection 611 in this example) presses the first moving member 16 downward via the transmission spring 8. On the other hand, when the armature 6 is located at the second position, the first plate 61 of the armature 6 (more specifically, the projection 611 in this example) presses the first moving member 16 upward via the transmission spring 8.

The return spring 7 is implemented as a metallic leaf spring and formed in an L-shape in a front view. The return spring 7 includes a pair of first pieces 71 and a second piece 72, all of which form integral parts of the return spring 7. The pair of first pieces 71 are both secured to the second plate 52 of the yoke 5. The second piece 72 is secured to the second plate 62 of the armature 6. The return spring 7 is configured to flex when the armature 6 is located at the first position. The return spring 7 tries to return to the original state, thereby applying biasing force of displacing the armature 6 from the first position to the second position to the armature 6. That is to say, the return spring 7 is configured to apply its elastic force to the armature 6 in such a direction as to displace the armature 6 from the first position to the second position.

The transmission spring 8 is provided in the upward/downward direction between the armature 6 and the first moving member 16 to transmit force between the armature 6 and the first moving member 16. That is to say, in this embodiment, force is transmitted either from the armature 6 to the first moving member 16 via the transmission spring 8 or from the first moving member 16 to the armature 6 via the transmission spring 8.

The transmission spring 8 may be implemented as a metallic leaf spring made of stainless steel (SUS), for example, as shown in FIG. 1. The transmission spring 8 includes a first plate 81, a second plate 82, and a third plate 83, all of which form integral parts of the transmission spring 8 and are each formed in a rectangular plate shape.

The first plate 81 has a hole 811 running through the thickness (upward/downward direction) thereof. In this embodiment, the shaft portion 141 of the first moving contact 14A, passed through the mounting hole 162 of the first moving member 16, is inserted into the hole 811 and caulked onto the first plate 81, thereby mounting the first plate 81 to the first moving member 16. Alternatively, the first plate 81 does not have to be mounted, along with the first moving contact 14A, onto the first moving member 16. That is to say, the transmission spring 8 may be mounted to another portion, different from the portion to which the first moving contact 14A is secured, of the first moving member 16.

The second plate 82 is integrated with the first plate 81 via the third plate 83 sloping obliquely upward from one end (left end) portion in the rightward/leftward direction of the first plate 81. The second plate 82 is located in the thickness direction (upward/downward direction) above the first plate 81. When the transmission spring 8 is mounted to the first moving member 16, the second plate 82 faces the first plate 61 of the armature 6 and comes into contact with the projection 611 of the first plate 61.

The case C1 may be made of a material with electrical insulation properties such as a ceramic or a synthetic resin, and may be formed in a box shape. The case C1 may be formed by joining a base C11 and a cover C12 together by, for example, welding, brazing, or bonding with a thermosetting resin adhesive. The case C1 houses the contact device A1 and the electromagnetic device B1. As shown in FIG. 2, the first terminal portion 113 of the first terminal plate 11 and the second terminal portion 123 of the second terminal plate 12 of the contact device A1 are exposed out of the case C1. As shown in FIG. 2, the pair of coil terminals 21 of the electromagnetic device B1 are also partially exposed out of the case C1.

(3) Arrangement of Moving Contacts and Fixed Contacts

Figure 5A:
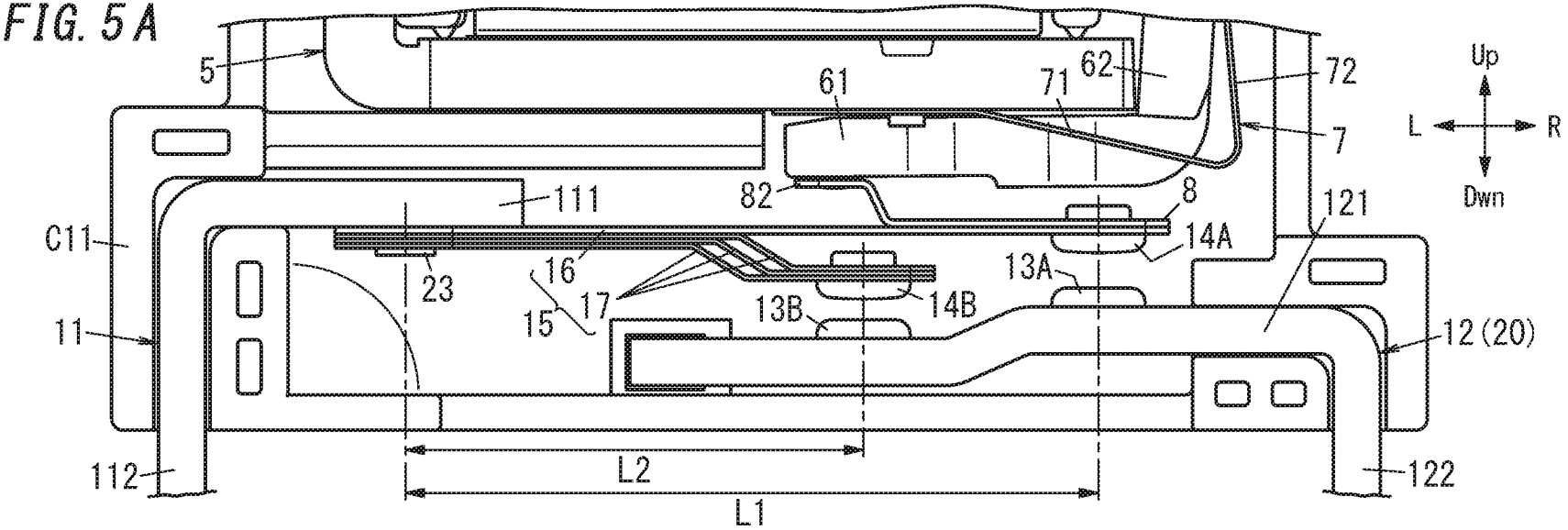
FIG. 5A is a front view, illustrating an OFF state of the contact device, of a part of the electromagnetic relay.

Next, the arrangement of the first fixed contact 13A, the pair of second fixed contacts 13B, the first moving contact 14A, and the pair of second moving contacts 14B will be described with reference to FIG. 5A. Note that although only one second fixed contact 13B and only one second moving contact 14B are shown in FIG. 5A, two second fixed contacts 13B and two second moving contacts 14B are actually provided in the third direction (i.e., the direction coming out of the paper).

The first fixed contact 13A and the pair of second fixed contacts 13B are mounted to the second lateral plate 121 of the second terminal plate 12. The first fixed contact 13A is located on the right of the pair of second fixed contacts 13B in the rightward/leftward direction (second direction). In addition, the first fixed contact 13A is located, in the upward/downward direction (first direction), above the pair of second fixed contacts 13B when a tip end portion (left end portion) of the second lateral plate 121 of the second terminal plate 12 is folded stepwise.

The first moving contact 14A is mounted to the first moving member 16. The pair of second moving contacts 14B are mounted to the multiple parts of the second moving member 17. The multiple parts of the second moving member 17 are arranged in the upward/downward direction (first direction) between the first moving member 16 and the fixed contact assembly 20. Also, the pair of second moving contacts 14B are mounted to the respective stepped portions 172 provided at the other end (right end) portions along the length (rightward/leftward direction) of those parts of the second moving member 17. Thus, the first moving contact 14A is located, in the upward/downward direction (first direction), above the pair of second moving contacts 14B. In addition, the first moving contact 14A is located, in the rightward/leftward direction (second direction), on the right of the pair of second moving contacts 14B. In other words, a first distance L1 from the one end in the second direction (rightward/leftward direction) of the first moving member 16 and second moving members 17 to the first moving contact 14A is longer than a second distance L2 from the one end in the second direction to the second moving contacts 14B.

Also, in this embodiment, the first fixed contact 13A and the first moving contact 14A face each other in the first direction, and the pair of second fixed contacts 13B and the pair of second moving contacts 14B face each other in the first direction.

In this manner, the first moving contact 14A and the pair of second moving contacts 14B are arranged side by side in the second direction (rightward/leftward direction). This allows the overall size of the electromagnetic relay 100 to be reduced in the third direction (i.e., along the thickness of the electromagnetic relay 100) intersecting with both of the first direction (upward/downward direction) and the second direction. In addition, the electromagnetic relay 100 according to this embodiment does not use any braided wire unlike the known electromagnetic relay, thus facilitating positioning of respective members and enabling automatic assembling as well. Furthermore, there is no need to perform an additional process step such as welding a braided wire.

In this embodiment, the pair of second moving contacts 14B are mounted to the respective stepped portions 172 of the multiple parts of the second moving member 17. This makes the gap between the pair of second moving contacts 14B and the pair of second fixed contacts 13B narrower in the first direction (upward/downward direction) than the gap between the first moving contact 14A and the first fixed contact 13A.

(4) Operation of Contact Device and Electromagnetic Relay

Figure 5B:
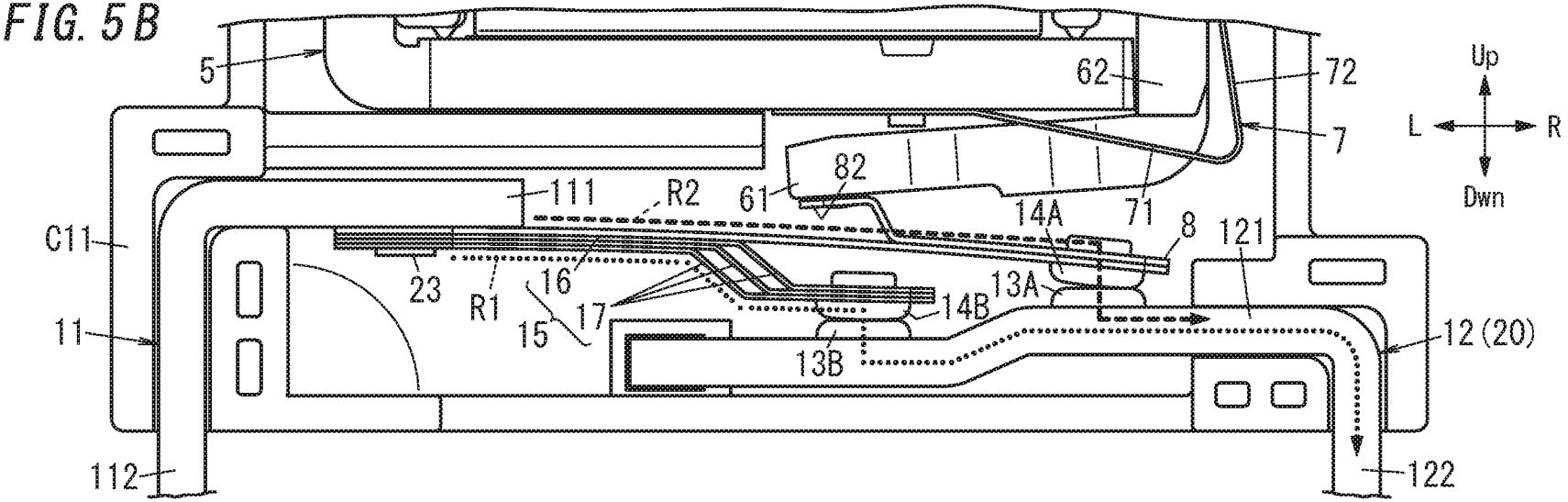
FIG. 5B is a front view, illustrating an ON state of the contact device, of the part of the electromagnetic relay.

Next, it will be described with reference to FIGS. 2, 5A, and 5B how the contact device A1 and electromagnetic relay 100 according to this embodiment operate. FIG. 5A is a front view, illustrating an OFF state of the contact device A1, of a part of the electromagnetic relay 100. FIG. 5B is a front view, illustrating an ON state of the contact device A1, of the same part of the electromagnetic relay 100. Note that although only one second fixed contact 13B and only one second moving contact 14B are shown in FIGS. 2, 5A, and 5B, two second fixed contacts 13B and two second moving contacts 14B are actually provided in the third direction (i.e., the direction coming out of the paper).

First, it will be described how the contact device A1 performs a closing operation. When the coil 2 is energized while the contact device A1 is OFF, the coil 2 generates a magnetic flux. Then, magnetic attraction is generated between the second plate 62 of the armature 6 and the attracting portion 41 of the stator 4. Thus, the second plate 62 is attracted toward the attracting portion 41 by overcoming the elastic force applied by the return spring 7. This causes the armature 6 to turn counterclockwise and move from the second position to the first position.

As the armature 6 moves to the first position, the first plate 61 (more specifically, the projection 611 in this example) of the armature 6 presses the second plate 82 of the transmission spring 8 downward. In response, the transmission spring 8 transmits the pressing force from the armature 6 to the first moving member 16. By being pressed downward with the force transmitted from the transmission spring 8, the first moving member 16 turns clockwise around the points (pins 23) where the first moving member 16 is fixed to the first terminal plate 11 as fulcrums. At this time, the second moving member 17 secured, along with the first moving member 16, to the first terminal plate 11 also rotate clockwise as the first moving member 16 rotates. That is to say, in that case, the first moving contact 14A and the pair of second moving contacts 14B move (rotate) as the first moving member 16 moves (rotates). In this case, the magnitude of displacement in the upward/downward direction of the first moving member 16 increases toward the tip (right end) thereof. Thus, the clockwise rotation of the first moving member 16 brings the first moving contact 14A into contact with the first fixed contact 13A first. This turns the contact device A1 ON and makes the first terminal plate 11 and the second terminal plate 12 electrically conductive with each other via the first fixed contact 13A and the first moving contact 14A.

As the armature 6 moves to the first position, the first plate 61 (more specifically, the projection 611 in this example) of the armature 6 presses the second plate 82 of the transmission spring 8 further downward. Then, the force transmitted from the transmission spring 8 causes the first moving member 16 to further rotate clockwise. This brings the pair of second moving contacts 14B into contact with the pair of second fixed contacts 13B, respectively. That is to say, in this state, the first moving contact 14A is already in contact with the first fixed contact 13A and the pair of second moving contacts 14B also comes into contact with the pair of second fixed contacts 13B, respectively. That is to say, the first moving member 16 and the second moving member 17 are configured to bring, at the time of the closing operation, the pair of second moving contacts 14B into contact with the pair of second fixed contacts 13B after having brought the first moving contact 14A into contact with the first fixed contact 13A.

Next, it will be described how the contact device A1 performs an opening operation. When de-energized while the contact device A1 is ON, the coil 2 stops generating a magnetic flux. Then, the magnetic attraction between the second plate 62 of the armature 6 and the attracting portion 41 of the stator 4 is also lost. This causes the armature 6 to rotate clockwise with the elastic force applied by the return spring 7 and move from the first position to the second position.

As the armature 6 moves to the second position, the downwardly pressing force that has been applied by the first plate 61 of the armature 6 to the first moving member 16 via the transmission spring 8 attenuates. Thus, the first moving member 16 recovers, with its own elastic force, from the downwardly flexed state and rotates counterclockwise around the fixing points (pins 23) as fulcrums. In that case, contrary to the closing operation, after the pair of second moving contacts 14B has gone out of contact with the pair of second fixed contacts 13B, the first moving contact 14A goes out of contact with the first fixed contact 13A. That is to say, the first moving member 16 and the second moving member 17 are configured to bring, at the time of the opening operation, the first moving contact 14A out of contact with the first fixed contact 13A after having brought the pair of second moving contacts 14B out of contact with the pair of second fixed contacts 13B.

When the armature 6 returns to the second position to finish moving, the armature 6 is locked at the second position. This causes the second plate 82 of the transmission spring 8 to be deformed elastically by being clamped between the first plate 61 of the armature 6 and the first moving member 16. That is to say, in a state where the first moving contact 14A is located at the first open position and the pair of second moving contacts 14B are located at the second open position, the transmission spring 8 comes into contact with the armature 6 (more specifically, the projection 611 in this example) while being elastically deformed.

Then, the restitution force of the second plate 82 of the transmission spring 8 is applied to the first moving member 16, thus decelerating the first moving member 16. Thus, the first moving member 16 stops vibrating and finishes moving by being pressed by the transmission spring 8.

In the contact device A1 according to this embodiment, in a state where the first moving contact 14A is located at the first closed position and the second moving contacts 14B are located at the second closed position, a first current path R1 and a second current path R2 are formed (see FIG. 5B). The first current path R1 is a path of a current flowing through the second moving member 17 and the pair of second moving contacts 14B into the pair of second fixed contacts 13B and then flowing from the pair of second fixed contacts 13B into the second terminal portion 123. The second current path R2 is a path of a current flowing through the first moving member 16 and the first moving contact 14A into the first fixed contact 13A. The first current path R1 and the second current path R2 face each other in the upward/downward direction (first direction). Also, the current flowing along the first current path R1 is directed rightward, and the current flowing along the second current path R2 is also directed rightward. When the currents flowing along the first current path R1 and the second current path R2 flow in the same direction in this manner, the electromagnetic forces generated by these two currents attract each other. Thus, the electromagnetic repulsion generated between the first fixed contact 13A and the first moving contact 14A and the electromagnetic repulsion generated between the pair of second fixed contacts 13B and the pair of second moving contacts 14B may be reduced by the mutually attracting electromagnetic forces.

In addition, when the first fixed contact 13A is located on the first current path R1 as in this embodiment, the current flowing along the second current path R2 into the first fixed contact 13A does not flow toward the second fixed contacts 13B. Thus, compared to a situation where the current flowing along the second current path R2 into the first fixed contact 13A flows toward the second fixed contacts 13B, the portion to which the second fixed contacts 13B are attached may have a reduced thickness.

Furthermore, when performing the closing operation, the contact device A1 according to this embodiment brings the pair of second moving contacts 14B into contact with the pair of second fixed contacts 13B after having brought the first moving contact 14A into contact with the first fixed contact 13A. Also, when performing the opening operation, the contact device A1 according to this embodiment brings the first moving contact 14A out of contact with the first fixed contact 13A after having brought the pair of second moving contacts 14B out of contact with the pair of second fixed contacts 13B. The configuration allows a material for the first fixed contact 13A and the first moving contact 14A and a material for the second fixed contacts 13B and second moving contacts 14B to be selected separately.

In that case, however, fused bonding, transfer, or any other unwanted phenomenon could arise between the first fixed contact 13A and the first moving contact 14A. That is why the first fixed contact 13A and the first moving contact 14A are suitably made of a material with higher resistance to fused bonding, transfer, and other phenomena than a material for the second fixed contacts 13B and second moving contacts 14B. Meanwhile, to allow a larger amount of current to flow through the second fixed contacts 13B and second moving contacts 14B than through the first fixed contact 13A and the first moving contact 14A, the second fixed contacts 13B and the second moving contacts 14B are suitably made of a material with high electrical conductivity. In this embodiment, the first fixed contact 13A and the first moving contact 14A form a first contact set 32 and the second fixed contacts 13B and the second moving contacts 14B form second contact sets 33.

As can be seen, selecting a material for the first fixed contact 13A and the first moving contact 14A and a material for the second fixed contacts 13B and the second moving contacts 14B separately from each other increases the degree of freedom of design for the first contact set 32 and the second contact sets 33.

In addition, splitting the current flowing through the contact device A1 into a current flowing along the first current path R1 and a current flowing along the second current path R2 as is done in this embodiment decreases the amount of current to flow along each of the first current path R1 and the second current path R2. This reduces the thermal deformation of the first moving member 16 and the second moving member 17, thus ensuring sufficiently high contact pressure between the first fixed contact 13A and the first moving contact 14A and between the second fixed contacts 13B and the second moving contacts 14B.

(5) Variations

Next, variations of the exemplary embodiment will be described.

(5.1) First Variation

In the exemplary embodiment described above, each part of the second moving member 17 includes a plurality of second moving contact divided pieces 173 and the second moving contacts 14B are mounted to the plurality of second moving contact divided pieces 173. However, this is only an example and should not be construed as limiting. Alternatively, the first moving member 16 may include a plurality of first moving contact divided pieces 182, to each of which the first moving contact 14A may be attached. Such a variation of the exemplary embodiment will be described as a first variation with reference to FIG. 6.

Figure 6:
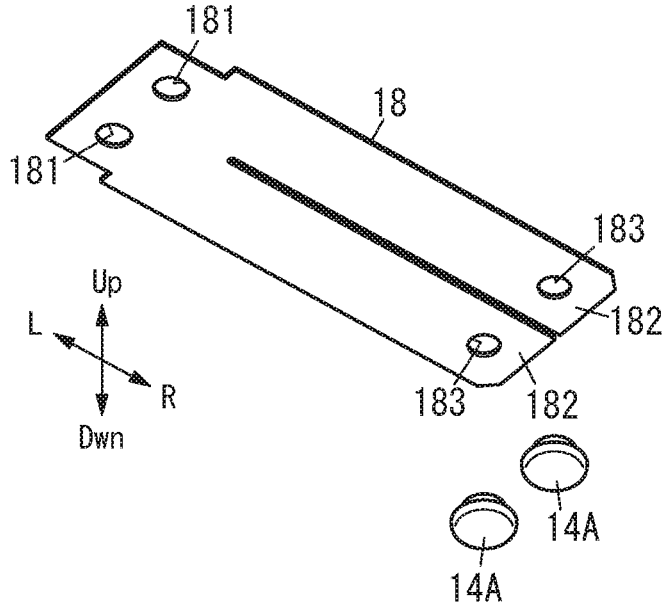
FIG. 6 is a perspective view illustrating a first moving member of a contact device according to a first variation of the exemplary embodiment of the present disclosure.

FIG. 6 is a perspective view illustrating an alternative first moving member 18 for a contact device A1 according to the first variation of the exemplary embodiment. The moving member 18 may be made of an electrically conductive material (such as copper) and formed in the shape of a plate elongated in the rightward/leftward direction. One end (left end) portion along the length (rightward/leftward direction) of the first moving member 18 has a pair of fixing holes 181 cut through the thickness (upward/downward direction) thereof. The other end (right end) portion along the length of the first moving member 18 is provided with a plurality of (e.g., two in the illustrated example) first moving contact divided pieces 182, which are divided along the width (third direction) intersecting with both of the length (second direction) and thickness (first direction) of the first moving member 18. Each of the plurality of first moving contact divided pieces 182 has a mounting hole 183 cut through the thickness thereof. The first moving contact 14A is mounted to each of these mounting holes 183.

As can be seen, providing the first moving contact 14A for each of the plurality of first moving contact divided pieces 182 that are divided in the third direction reduces dispersion in contact pressure between a plurality of first moving contacts 14A.

(5.2) Other Variations

In the exemplary embodiment described above, the moving contact assembly 15 is made up of the single part of the first moving member 16 and the three parts of the second moving member 17. However, this is only an example and should not be construed as limiting. Rather, the moving contact assembly 15 may include any other number of parts as the first moving member 16 and any other number of parts as the second moving member 17 as long as at least one part is provided as the first moving member 16 and at least one part is provided as the second moving member 17. Also, the number of parts provided as the first moving member 16 may be either equal to, or different from, the number of parts provided as the second moving member 17.

Also, in the exemplary embodiment described above, the multiple parts of the second moving member 17 are each implemented as a leaf spring. However, this is only an example and should not be construed as limiting. Alternatively, as long as the first moving member 16 is a leaf spring, the second moving member 17 may consist of any other type of plate members with sufficient strength along the thickness thereof.

Furthermore, in the exemplary embodiment and first variation described above, the number of the second moving contact divided pieces 173 and the number of the first moving contact divided pieces 182 are each supposed to be two. However, this is only an example and should not be construed as limiting. Alternatively, their numbers may also be three or more. Furthermore, either the first moving member 16 or the second moving member 17 may be divided, or both of the first moving member 16 and the second moving member 17 may be divided, whichever is appropriate. If the first moving member 16 and the second moving member 17 are both divided, then the number of the first moving contact divided pieces 182 may be equal to, or different from, the number of the second moving contact divided pieces 173, whichever is appropriate. Furthermore, in the exemplary embodiment and first variation described above, only the tip in the rightward/leftward direction (second direction) of the first moving member 16 or the second moving member 17 is divided. However, this is only an example and should not be construed as limiting. Alternatively, the first moving member 16 or the second moving member 17 may also be divided entirely in the rightward/leftward direction.

Furthermore, in the exemplary embodiment described above, the first moving member 16 and the second moving member 17 are brought into close contact with each other in the upward/downward direction (first direction). However, this is only an example and should not be construed as limiting. Alternatively, spacers or any other members may be interposed between the first moving member 16 and the second moving member 17. That is to say, the second moving member 17 only needs to be arranged between the first moving member 16 and the fixed contact assembly 20 in the first direction.

Furthermore, in the exemplary embodiment described above, a set of contacts including the first fixed contact 13A and the first moving contact 14A is used as a first contact set, and two pairs of contacts consisting of the second fixed contacts 13B and second moving contacts 14B are used as second contact sets. However, these sets of contacts may switch their roles with each other. That is to say, the two pairs of contacts consisting of the second fixed contacts 13B and the second moving contacts 14B may also be used as first contact sets, and the set of contacts including the first fixed contact 13A and the first moving contact 14A may also be used as a second contact set. In that case, at the time of closing operation, after the second moving contacts 14B have been brought into contact with the second fixed contacts 13B, the first moving contact 14A is brought into contact with the first fixed contact 13A. Meanwhile, at the time of opening operation, after the first moving contact 14A has been brought out of contact with the first fixed contact 13A, the second moving contacts 14B are brought out of contact with the second fixed contacts 13B.

Furthermore, in the exemplary embodiment described above, two second fixed contacts 13B and two second moving contacts 14B are provided. However, this is only an example and should not be construed as limiting. Alternatively, any other number of second fixed contacts 13B and any other number of second moving contacts 14B may also be provided as long as at least one second fixed contact 13B and at least one second moving contact 14B are provided.

Furthermore, in the exemplary embodiment described above, the force applied from the armature 6 is transmitted via the transmission spring 8 to the first moving member 16. However, this is only an example and should not be construed as limiting. Alternatively, the force applied from the armature 6 may be transmitted directly to the first moving member 16. In other words, the transmission spring 8 may be omitted.

The electromagnetic relay 100 according to the exemplary embodiment described above may be used as any of an a-contact relay, a b-contact relay, or a c-contact relay. For example, when the electromagnetic relay 100 is used in a c-contact relay, not only the first fixed contact 13A and the second fixed contacts 13B but also plurality of additional fixed contacts to respectively come into contact with the first moving contact 14A and second moving contacts 14B at the open position may be provided. This configuration allows electrical paths to be switched between a first electrical path and a second electrical path depending on whether the coil 2 is energized or de-energized. The first electrical path is an electrical path formed by bringing the first moving contact 14A into contact with the fixed contact 13A and the second moving contacts 14B into contact with the second fixed contacts 13B at the closed position. The second electrical path is an electrical path formed by bringing the first moving contact 14A and second moving contacts 14B into contact with the plurality of additional fixed contacts, provided separately from the first fixed contact 13A and the second fixed contacts 13B, at the open position.

(Resume)

As can be seen from the foregoing description of embodiments, a contact device (A1) according to a first aspect includes a fixed contact assembly (20) and a moving contact assembly (15). The fixed contact assembly (20) includes a first fixed contact (13A) and a second fixed contact (13B). The moving contact assembly (15) includes a first moving contact (14A) and a second moving contact (14B). The first moving contact (14A) faces, in a first direction (upward/downward direction), the first fixed contact (13A), and moves back and forth between a first closed position where the first moving contact (14A) comes into contact with the first fixed contact (13A) and a first open position where the first moving contact (14A) goes out of contact with the first fixed contact (13A). The second moving contact (14B) faces, in the first direction, the second fixed contact (13B), and moves back and forth between a second closed position where the second moving contact (14B) comes into contact with the second fixed contact (13B) and a second open position where the second moving contact (14B) goes out of contact with the second fixed contact (13B). The moving contact assembly (15) further includes a first moving member (16, 18) and a second moving member (17). The first moving member (16, 18) is implemented as a leaf spring and is provided with the first moving contact (14A). The second moving member (17) is provided with the second moving contact (14B). The second moving member (17) is arranged, in the first direction, between the first moving member (16, 18) and the fixed contact assembly (20). The second moving member (17) is fixed to the first moving member (16, 18) at one end (left end) in a second direction (rightward/leftward direction) intersecting with the first direction. The first moving contact (14A) and the second moving contact (14B) are configured to move as the first moving member (16, 18) moves. A first distance (L1) from the one end in the second direction of the second moving member (17) to the first moving contact (14A) is longer than a second distance (L2) from the one end in the second direction of the second moving member (17) to the second moving contact (14B).

The contact device (A1) according to the first aspect is configured such that at the closed position, the first fixed contact (13A) and the first moving contact (14A) come into contact with each other and the second fixed contact (13B) and the second moving contact (14B) come into contact with each other. In addition, the first moving contact (14A) and the second moving contact (14B) are arranged side by side in a second direction intersecting with the first direction. This allows the overall size of the contact device (A1) to be reduced in a third direction intersecting with both of the first and second directions while energizing the contact device A1 with a large amount of current supplied.

In a contact device (A1) according to a second aspect, which may be implemented in conjunction with the first aspect, the second moving member (17) is implemented as a leaf spring.

The second aspect increases the contact pressure between the second fixed contact (13B) and the second moving contact (14B) compared to a situation where the second moving member (17) is not implemented as a leaf spring. However, this is not an essential configuration and the second moving member (17) does not have to be implemented as a leaf spring. Alternatively, the second moving member (17) may also be implemented as a plate member with sufficient strength in the thickness direction.

In a contact device (A1) according to a third aspect, which may be implemented in conjunction with the first or second aspect, the second moving member (17) includes, at the other end (right end) in the second direction (rightward/leftward direction), a stepped portion (172) protruding, in the first direction, away from the first moving member (16, 18).

According to the third aspect, providing the second moving contact (14B) at the stepped portion (172) reduces the chances of the second moving contact (14B) interfering with the first moving member (16, 18) even when the first moving member (16, 18) and the second moving member (17) are brought into close contact with each other. However, this is not an essential configuration and the second moving member (17) may have no stepped portions (172).

In a contact device (A1) according to a fourth aspect, which may be implemented in conjunction with any one of the first to third aspects, the second moving member (17) includes: a plurality of the second moving contacts (14B); and a plurality of second moving contact divided pieces (173). The plurality of second moving contact divided pieces (173) are divided, at the other end (right end) in the second direction (rightward/leftward direction), in a third direction intersecting with both of the first direction and the second direction. The plurality of the second moving contacts (14B) corresponds one to one to the plurality of second moving contact divided pieces (173). Each of the plurality of second moving contact divided pieces (173) is provided with an associated one of the plurality of the second moving contacts (14B).

According to the fourth aspect, each of the plurality of second moving contact divided pieces (173) divided in the third direction is provided with one of the second moving contacts (14B), thus reducing dispersion in contact pressure between the plurality of second moving contacts (14B). However, this is not an essential configuration and the second moving member (17) need not include the plurality of second moving contact divided pieces (173). In other words, the other end in the second direction of the second moving member (17) does not have to be divided in the third direction.

In a contact device (A1) according to a fifth aspect, which may be implemented in conjunction with any one of the first to fourth aspects, the first moving member (18) includes: a plurality of the first moving contacts (14A); and a plurality of first moving contact divided pieces (182). The plurality of first moving contact divided pieces (182) are divided, at the other end (right end) in the second direction (rightward/leftward direction), in a third direction intersecting with both of the first direction and the second direction. The plurality of the first moving contacts (14A) corresponds one to one to the plurality of first moving contact divided pieces (182). Each of the plurality of first moving contact divided pieces (182) is provided with an associated one of the plurality of the first moving contacts (14A).

According to the fifth aspect, each of the plurality of first moving contact divided pieces (182) divided in the third direction is provided with one of the first moving contacts (14A), thus reducing dispersion in contact pressure between the plurality of first moving contacts (14A). However, this is not an essential configuration and the first moving member (18) need not include the plurality of first moving contact divided pieces (182). In other words, the other end in the second direction of the first moving member (18) does not have to be divided in the third direction.

In a contact device (A1) according to a sixth aspect, which may be implemented in conjunction with any one of the first to fifth aspects, supposing one set of contacts, selected from a set of contacts including the first moving contact (14A) and the first fixed contact (13A) and another set of contacts including the second moving contact (14B) and the second fixed contact (13B), is called a first contact set (32) and the other set of contacts is called a second contact set (33), the first moving member (16, 18) and the second moving member (17) are configured to perform a closing operation of closing the first contact set (32) and the second contact set (33) in this order by closing the second contact set (33) after having closed the first contact set (32) and also perform an opening operation of opening the first contact set (32) and the second contact set (33) in reverse order by opening the first contact set (32) after having opened the second contact set (33). The first contact set (32) and the second contact set (33) are configured to allow a larger amount of current to flow through the second contact set (33) than through the first contact set (32) when the first contact set (32) and the second contact set (33) are closed.

The sixth aspect allows a material for the contacts of the first contact set (32) and a material for the contacts of the second contact set (33) to be selected separately, thus increasing the degree of freedom of design for the first contact set (32) and the second contact set (33). Alternatively, the first moving member (16, 18) and the second moving member (17) may also be configured to perform the closing operation by closing the first contact set (32) after having closed the second contact set (33) and perform the opening operation by opening the second contact set (33) after having opened the first contact set (32).

In a contact device (A1) according to a seventh aspect, which may be implemented in conjunction with any one of the first to sixth aspects, the fixed contact assembly (20)

further includes a terminal portion (123) to be electrically connected to an external circuit. The first fixed contact (13A) is located on a current path (R1) of a current flowing from the second fixed contact (13B) toward the terminal portion (123).

According to the seventh aspect, the current flowing through the first fixed contact (13A) does not flow toward the second fixed contact (13B). This reduces, compared to a situation where the current flows toward the second fixed contact (13B), the thickness of a portion to which the second fixed contact (13B) is attached. However, this is not an essential configuration and the first fixed contact (13A) does not have to be located on the current path (R1).

In a contact device (A1) according to an eighth aspect, which may be implemented in conjunction with any one of the first to seventh aspects, the fixed contact assembly (20) further includes a terminal portion (123) to be electrically connected to an external circuit. A first current path (R1) of a current flowing from the second fixed contact (13B) toward the terminal portion (123) and a second current path (R2) of a current flowing through the first moving member (16, 18) toward the first moving contact (14A) face each other in the first direction. The current flowing along the first current path (R1) has the same direction as the current flowing along the second current path (R2).

According to the eighth aspect, the first current path (R1) and the second current path (R2) face each other in the first direction, and the current flowing along the first current path (R1) has the same direction as the current flowing along the second current path (R2). Thus, electromagnetic force generated by the flow of a current along the first current path (R1) and electromagnetic force generated by the flow of a current along the second current path (R2) attract each other, thus reducing electromagnetic repulsion to be caused between the contacts. However, this is not an essential configuration and the direction of the current flowing along the first current path (R1) and the direction of the current flowing along the second current path (R2) do not have to be the same.

In a contact device (A1) according to a ninth aspect, which may be implemented in conjunction with any one of the first to eighth aspects, the second moving member (17) is implemented as a leaf spring. The first moving member (16, 18) is comprised of a first number of parts. The second moving member (17) is comprised of a second number of parts. The first number is different from the second number.

According to the ninth aspect, making the number parts of the first moving member (16, 18) provided different from that of the second moving member (17) provided allows the current flowing through the moving contact assembly (15) to have an arbitrary current capacity. However, this is not an essential configuration and the number of parts of the first moving member (16, 18) provided may be equal to that of the second moving member (17) provided.

An electromagnetic relay (100) according to a tenth aspect includes: the contact device (A1) according to any one of the first to ninth aspects; and an electromagnetic device (B1). The electromagnetic device (B1) includes a coil (2) and configured to move the moving contact assembly (15) depending on whether the coil (2) is energized or not.

According to the tenth aspect, using the contact device (A1) according to any one of the first to ninth aspects allows the electromagnetic relay (100) to have its overall size reduced in a third direction (i.e., a direction intersecting with both of the first and second directions) while energizing the electromagnetic relay 100 with a large amount of current supplied.

In a contact device (A1) according to an eleventh aspect, which may be implemented in conjunction with the eighth aspect, the first fixed contact (13A) is located on the first current path (R1), and the current flowing through the second current path (R2) further flows from the first moving contact (14A) toward the fixed contact assembly (20) via the first fixed contact (13A).

In a contact device (A1) according to a twelfth aspect, which may be implemented in conjunction with the eleventh aspect, the second current path (R2) is confluent with the first current path (R1) in the vicinity of the first fixed contact (13A).

The invention claimed is:

1. A contact device comprising:

a fixed contact assembly including a first fixed contact and a second fixed contact; and a moving contact assembly including a first moving contact and a second moving contact;

the first moving contact facing, in a first direction, the first fixed contact, and moving back and forth between a first closed position where the first moving contact comes into contact with the first fixed contact and a first open position where the first moving contact goes out of contact with the first fixed contact, the second moving contact facing, in the first direction, the second fixed contact, and moving back and forth between a second closed position where the second moving contact comes into contact with the second fixed contact and a second open position where the second moving contact goes out of contact with the second fixed contact, the moving contact assembly further including: a first moving member implemented as a leaf spring and provided with the first moving contact; and a second moving member provided with the second moving contact, the second moving member being arranged, in the first direction, between the first moving member and the fixed contact assembly and fixed to the first moving member at one end in a second direction intersecting with the first direction, the first moving contact and the second moving contact being configured to move as the first moving member moves, a first distance from the one end in the second direction to the first moving contact being longer than a second distance from the one end in the second direction to the second moving contact.

2. The contact device of claim 1, wherein the second moving member is implemented as a leaf spring.

3. The contact device of claim 1, wherein the second moving member includes, at the other end in the second direction, a stepped portion protruding, in the first direction, away from the first moving member.

4. The contact device of claim 1, wherein the second moving member includes: a plurality of the second moving contacts; and a plurality of second moving contact divided pieces which are divided, at the other end in the second direction, in a third direction intersecting with both of the first direction and the second direction, the plurality of the second moving contacts corresponds one to one to the plurality of second moving contact divided pieces, and each of the plurality of second moving contact divided pieces is provided with an associated one of the plurality of the second moving contacts.

5. The contact device of claim 1, wherein the first moving member includes: a plurality of the first moving contacts; and a plurality of first moving contact divided pieces which are divided, at the other end in the second direction, in a third direction intersecting with both of the first direction and the second direction, the plurality of the first moving contacts corresponds one to one to the plurality of first moving contact divided pieces, and each of the plurality of first moving contact divided pieces is provided with an associated one of the plurality of the first moving contacts.

6. The contact device of claim 1, wherein supposing one set of contacts, selected from a set of contacts including the first moving contact and the first fixed contact and another set of contacts including the second moving contact and the second fixed contact, is called a first contact set and the other set of contacts is called a second contact set, the first moving member and the second moving member are configured to perform a closing operation of closing the first contact set and the second contact set in this order by closing the second contact set after having closed the first contact set and also perform an opening operation of opening the first contact set and the second contact set in reverse order by opening the first contact set after having opened the second contact set, and the first contact set and the second contact set are configured to allow a larger amount of current to flow through the second contact set than through the first contact set when the first contact set and the second contact set are closed.

7. The contact device of claim 1, wherein the fixed contact assembly further includes a terminal portion to be electrically connected to an external circuit, and the first fixed contact is located on a current path of a current flowing from the second fixed contact toward the terminal portion.

8. The contact device of claim 1, wherein the fixed contact assembly further includes a terminal portion to be electrically connected to an external circuit, a first current path of a current flowing from the second fixed contact toward the terminal portion and a second current path of a current flowing through the first moving member toward the first moving contact face each other in the first direction, and the current flowing along the first current path has the same direction as the current flowing along the second current path.

9. The contact device of claim 1, wherein the second moving member is implemented as a leaf spring, and the first moving member is comprised of a first number of parts, the second moving member is comprised of a second number of parts, and the first number is different from the second number.

10. An electromagnetic relay comprising:

the contact device of claim 1; and an electromagnetic device including a coil and configured to move the moving contact assembly depending on whether the coil is energized or not.

11. The contact device of claim 8, wherein the first fixed contact is located on the first current path, and the current flowing through the second current path further flows from the first moving contact toward the fixed contact assembly via the first fixed contact.

12. The contact device of claim 11, wherein the second current path is confluent with the first current path in the vicinity of the first fixed contact.

* * * * *